United States Patent [19]

Sayer

[11] Patent Number: 5,007,219

[45] Date of Patent: Apr. 16, 1991

[54] ROUND TOP WINDOW

[75] Inventor: Bertram Sayer, Princeton, N.J.

[73] Assignee: 501 Thermal Profiles, Inc., Keasbey, N.J.

[21] Appl. No.: 154,896

[22] Filed: Feb. 11, 1988

[51] Int. Cl.[5] ..... E06B 1/26

[52] U.S. Cl. ..... 52/204

[58] Field of Search ..... 52/204, 213, 211, 208; 49/504

[56] References Cited

U.S. PATENT DOCUMENTS

| | | | |
|---|---|---|---|
| 2,388,786 | 11/1945 | Knight | 52/208 |
| 3,208,564 | 9/1965 | Sitterly | 52/213 |
| 3,694,961 | 10/1972 | Johnson | 52/213 |
| 4,563,846 | 1/1986 | Webb | 52/208 |
| 4,462,955 | 2/1987 | Webb | 52/208 |
| 4,693,043 | 9/1987 | Knapp | 52/204 |

*Primary Examiner*—John E. Murtagh

*Attorney, Agent, or Firm*—Bernard Malina

[57] ABSTRACT

A round top window includes a flexible master frame member which is bent to the desired degree of curvature and then joined to a straight master frame member. A stop member is attached to the master frame members to provide support for a glazing assembly which is held in place by an elastomeric glazing bead. Nailing fins are provided on the round top window in order to facilitate attachment to the frame of a building structure.

18 Claims, 3 Drawing Sheets

FIG. 3
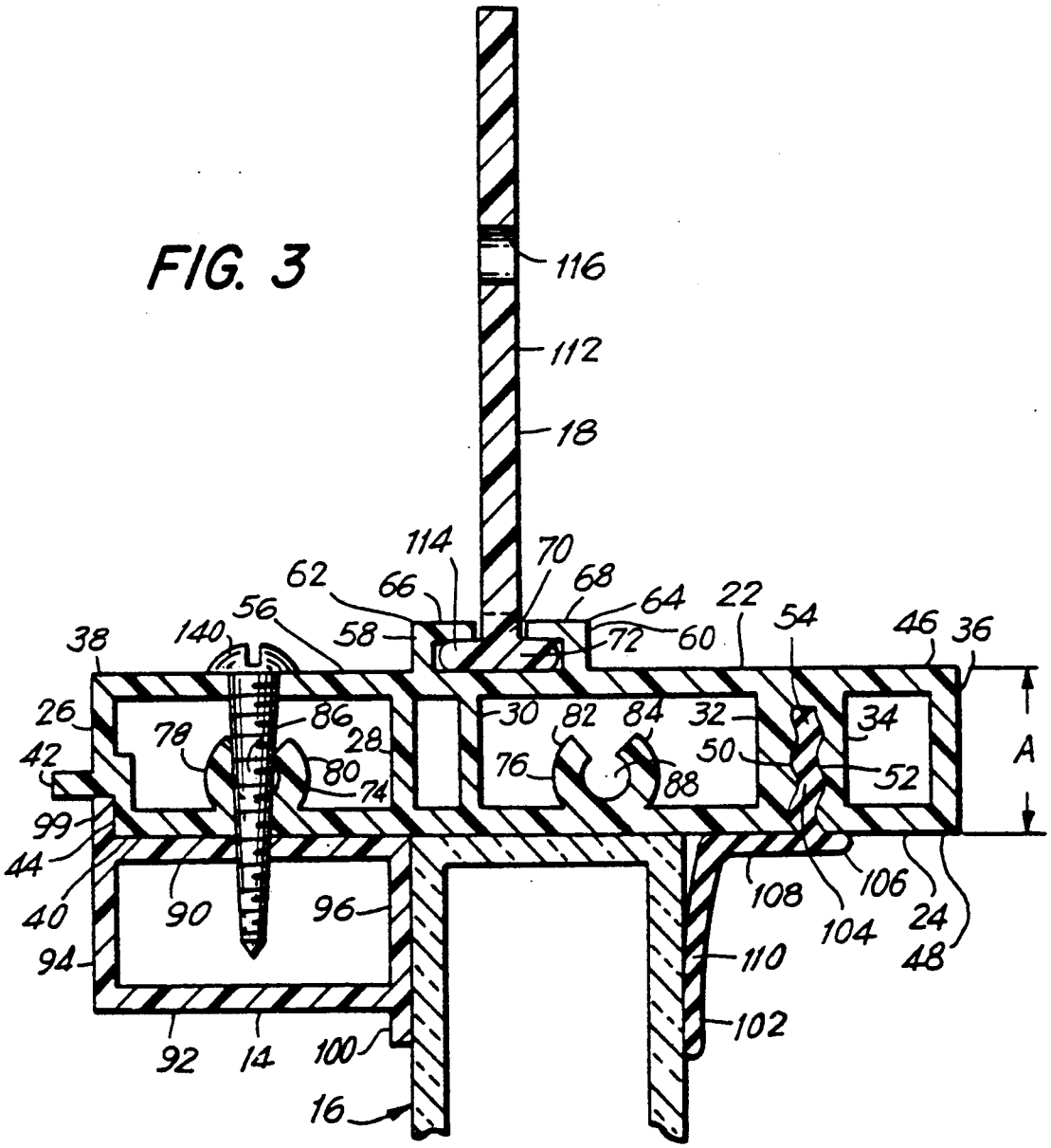
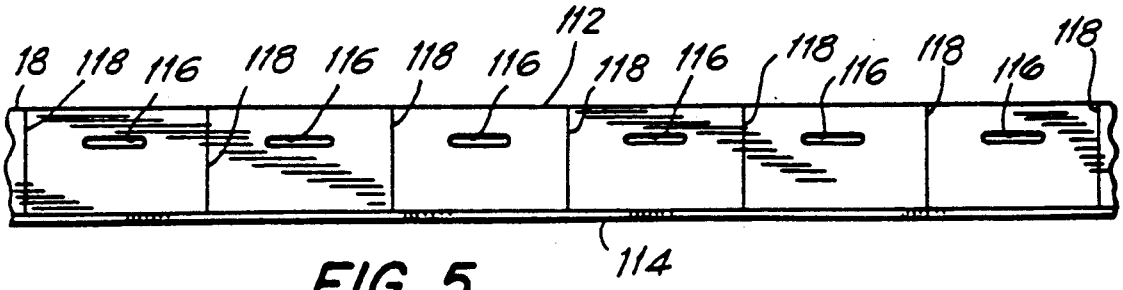
FIG. 5

ROUND TOP WINDOW

BACKGROUND OF THE INVENTION

There is a longstanding need in the area of architectural window frames for a window frame which has a curved or rounded top portion. In the past, wooden frames with rounded tops were fabricated using a plurality of individual segments which are connected together and which are then machined to form a curved configuration.

Conventional round top vinyl windows make use of the thermoplastic properties of polyvinyl chloride window lineals or framing materials. The construction of a conventional round top vinyl window involves the heating of the window lineals to the point where they are pliable and forming them into the desired round top shape. This process is slow and requires sophisticated expensive machinery to avoid excessive distortion of the lineals.

OBJECTS OF THE INVENTION

It is an object of the present invention to overcome the disadvantages of the prior art by providing a round top window which can be fabricated easily without the need to apply heat.

Another object of the present invention is to provide a round top window in which the framing material is segmented into relatively thin shapes which may be easily bent and then assembled to form a rigid window frame.

Another object of the present invention is to provide a round top window which can utilize heat during the forming process to reduce the amount of force required.

Still another object of the present invention is to provide a round top window which utilizes a relatively small number of relatively simple components which are economical to manufacture.

SUMMARY OF THE INVENTION

In accordance with the present invention, there is provided a round top window which comprises a curved master frame member and a curved stop member which are bent to a desired degree of curvature and the ends of the curved master frame member are joined to the ends of a straight master frame member using screws. The curved stop member is joined to the curved master frame member and an appropriately shaped window glazing member is inserted into the round top window frame. The window glazing is held in place by the stop member and a glazing bead which is inserted into a convoluted slot formed in the master frame member. The master frame member also has provisions for mounting a nailing fin which is used to attach the round top window frame to the structure of a building.

BRIEF DESCRIPTION OF THE DRAWING

Additional objects and advantages and a further understanding of the present invention may be had by referring to the following and drawings in which:

FIG. 3 is a cross-sectional view taken along the line 3—3 of FIG. 1;

Figure 1:
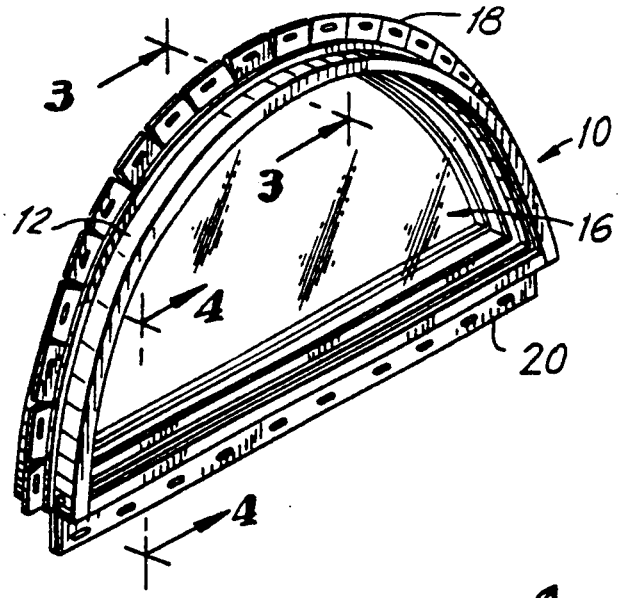
FIG. 1 is an overall perspective view of a round top window made with the present invention.

FIG. elevation view of the upper nailing fin member of the of FIG. 1; and

Figure 6:
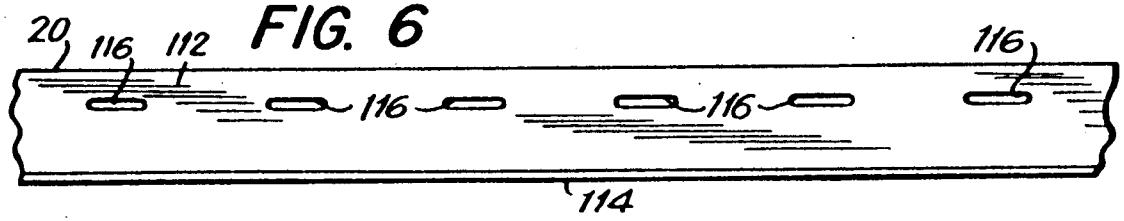

FIG. 6 is an elevation view of the lower nailing fin member of the apparatus of FIG. 1.

DETAILED DESCRIPTION OF THE INVENTION

With reference to the drawings, there is shown in FIG. 1 a round top window 10 made in accordance with the present invention which includes a master frame 12, a blind stop member 14, a glazing assembly 16, an upper nailing fin 18, and a lower nailing fin 20.

The master frame 12 which forms a major novel feature of the present invention is best shown in FIG. 3. The master frame 12 which is formed as a unitary extruded member includes an upper horizontal wall portion 22 and a lower horizontal wall portion 24 which are held in a spaced apart and generally parallel relationship by a plurality of vertical walls 26, 28, 30, 34, 36. The vertical wall 26 connects the edges 38, 40 of the upper and lower horizontal walls 22, 24. The vertical wall 26 includes a relatively short horizontal fin 42 and an inwardly stepped portion 44. The vertical wall 36 connects the edges 46, 48 of the upper and lower horizontal walls 22, 24. The vertical walls 32, 34 are relatively closely spaced and have facing convoluted surfaces 50, 52 which define a convoluted space 54, the purpose of which will be presently described. The vertical walls 28, 30 are positioned generally centrally located between the wall 26 and the wall 32. The upper surface 56 of the upper horizontal wall portion 22 includes a pair of relatively short spaced apart vertical wall portions 58, 60, the upper edges 62, 64 of which include horizontal wall portions 66, 68 which project toward each other forming a slot 70 which communicates with a space 72 which is wider than the slot 70.

The lower wall portion 24 includes a first and a second pair of curved projecting fins 74, 76. Each pair of projecting fins 74, 76 comprises relatively closer spaced pairs of curved members 78, 80, 82, 84 which define a pair of nearly closed circular spaces 86, 88.

The preferred height of the master frame 12 is limited to a maximum of 0.62 inches, as defined by the dimension A in FIG. 3. A preferred value for this dimension is in the order of 0.40 inches. In order to ensure the proper flexibility of this member 12, all protuberances in the direction of the bend radius are limited to a height of 0.25 inches.

The blind stop member 14 is an integrally formed hollow member which is generally rectangular in cross-section. The blind stop member 14 includes spaced apart horizontal wall portions 90, 92 and spaced apart vertical wall portions 94, 96. The vertical wall portions 94, 96 each have lip portions 99, 100 which project slightly beyond the horizontal wall portions 90, 92 respectively.

The glazing bead 102 is an integrally formed elastomeric member which includes a relatively short first vertical fin 104, a pair of oppositely directed horizontal fins 106, 108, and a relatively longer second vertical fin 110 which is directed opposite to the first vertical fin 104.

Figure 4:
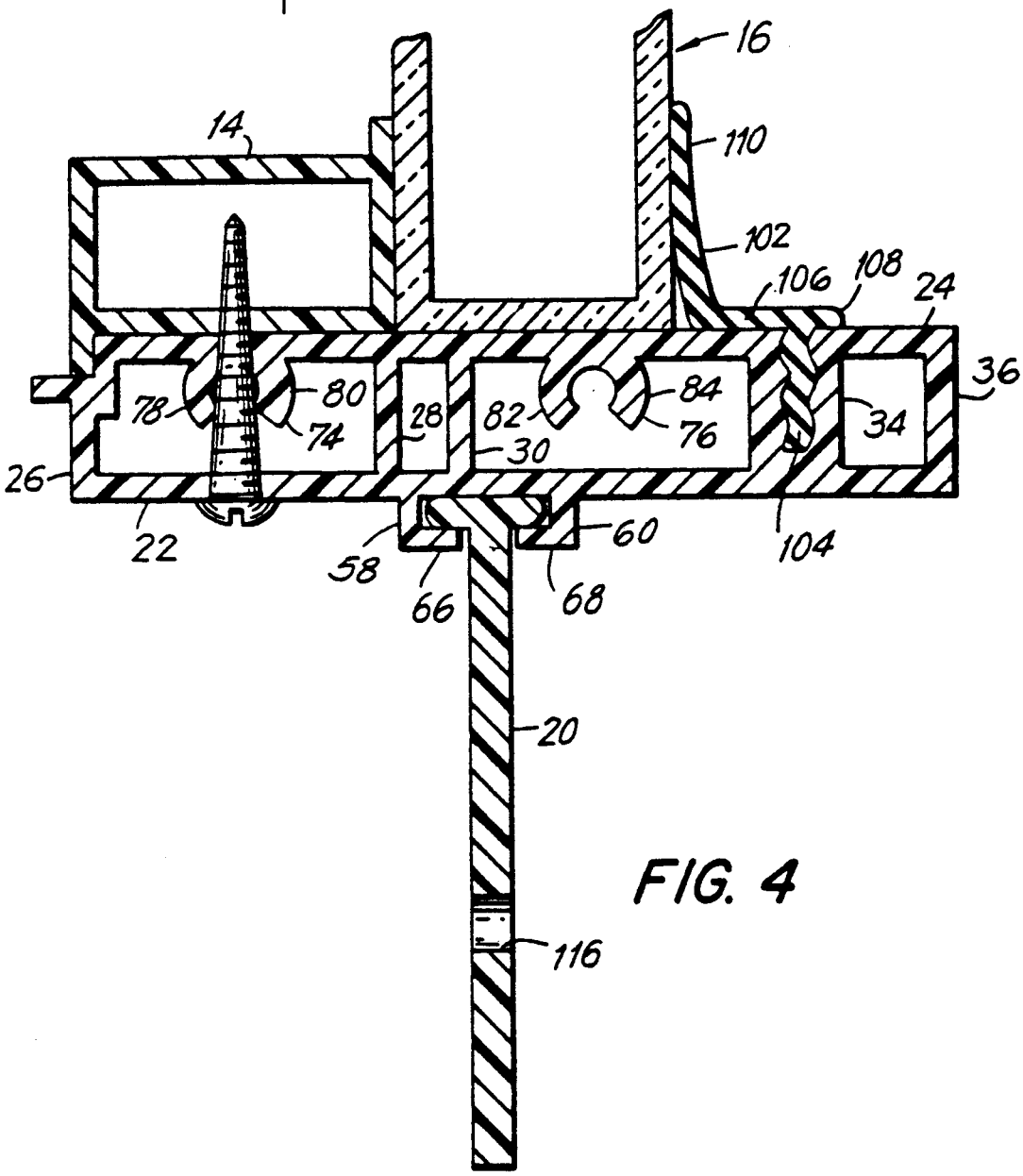
FIG. 4 is a cross-sectional view taken along the line 4—4 of FIG. 1.
Figure 2:
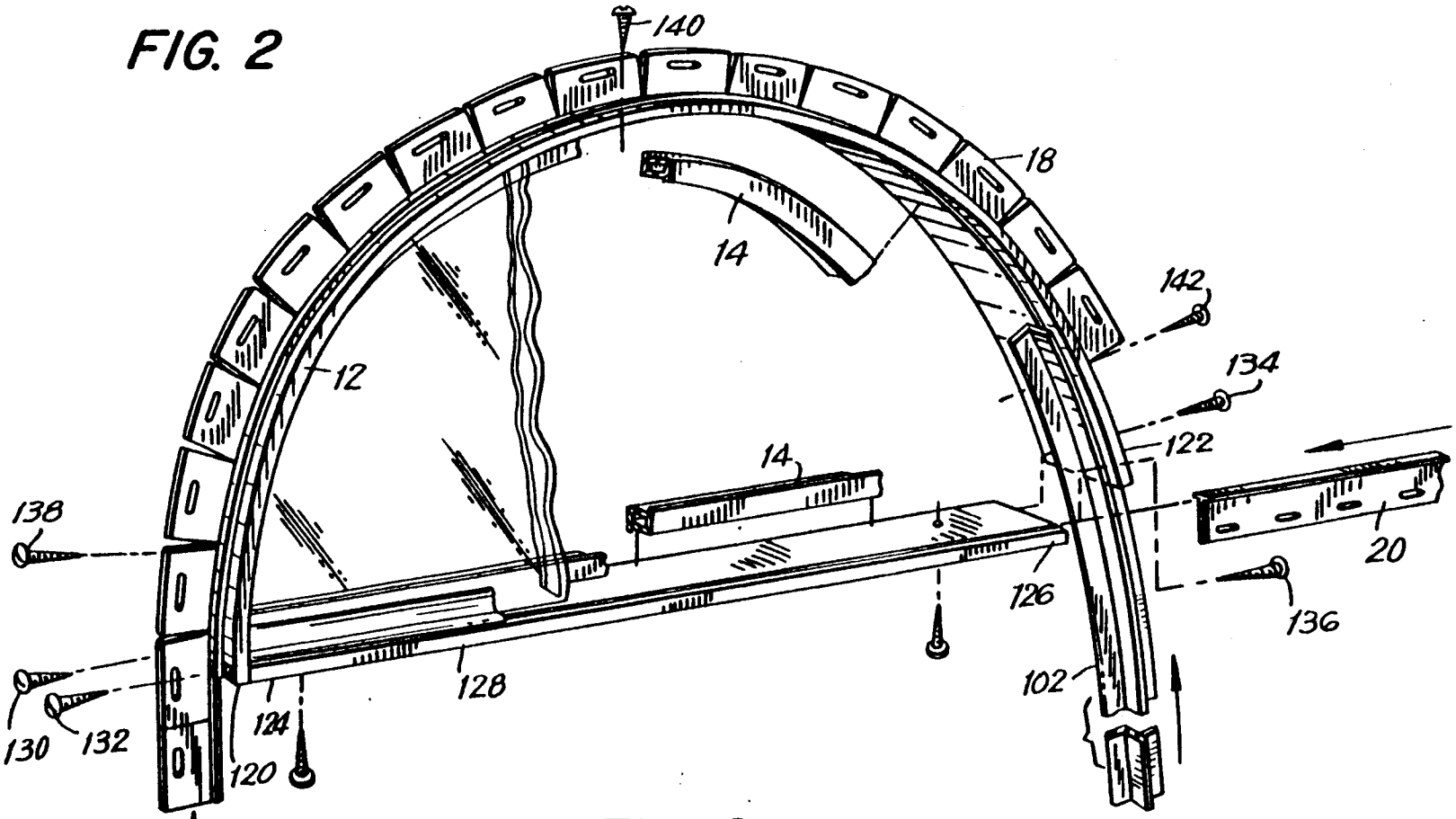
FIG. 2 is an exploded perspective view of the round top window of FIG. 1.

The upper and lower nailing fins 18, 20 are best shown in FIGS. 5 and 6. The upper and lower nailing fins are each integrally formed members which are generally T shaped in cross-section as is shown in FIGS. 2, 3 and 4. The upper and lower nailing fins 18, 20 each include a relatively longer vertical leg 112 which projects from a relatively shorter horizontal leg 114. The vertical legs 112 include a plurality of slots 116 which facilitate the nailing of the round top window 10 to the frame of a structure. The upper and lower nailing fins 18, 20 differ in that the upper nailing fin 18 includes a plurality of vertical slots 118 which divide the vertical leg 112 and permit the upper nailing fin 18 to easily flex. The horizontal leg 114 is proportioned to fit into the space 72 and the vertical legs 112 of the upper and lower nailing fins 18, 20 are proportioned to project through the slot 70.

During assembly of the round top window 10, the upper nailing fin 18 is slid into the space 72. The master frame member 12 and the blind stop member 14 are bent to form the desired curve, as is shown in FIGS. 1 and 2, and the lower ends 120, 122 of the master frame member 12 are placed abutting the ends 124, 126 of the master frame member 128. The master frame members 12 and 128 are identical in construction and differ only in length. Screws 130, 132, 134, 136 are driven through the master frame member 12 and into the spaces 86, 88 defined by the curved members 78, 80, 82, 84 in the master frame member 128, thereby joining the master frame members 12 and 128. The bent blind stop member 14 is connected to the master frame member 12 by screws 138, 140, 142, as is shown in FIGS. 2 and 3.

The blind stop member 144 is connected to the master frame member 128 by a pair of screws 146, 148 as is shown in FIGS. 3 and 4.

At this point, the window glazing 16, which is conventional in nature, is placed into the round top window 10 and the vertical fin 104 of the glazing bead 102 is formed into the convoluted space 54, as is shown in FIG. 3, thereby holding the window glazing 16 in place.

The bending of the master frame member 12 and the blind stop member 14 is accomplished by immersing these members in a water bath having a temperature of 170 degrees F. for 30 seconds and then bending these members over a wooden form which has the desired curvature. The bending of these members is accomplished easily and without distortion.

Tests have been performed using conventional lineal members made of the same material as the round top window frame 10 according to the present invention and subjecting these conventional lineal members to the same immersion bath as the round top frame according to the present invention. The result of these tests has indicated that the conventional lineals had an excessive amount of distortion which could be overcome only through the use of time consuming and expensive equipment.

While a preferred embodiment of the invention has been shown and described herein, it is obvious that numerous additions, changes and omissions may be made in such embodiments without departing from the spirit and scope of the invention.

What is claimed is:

1. A round top window frame comprising a first individually formed flexible elongated member having a first end and a second end, with said first elongated member having a curved configuration, a second individually formed elongated member having a first end and a second end, with said second elongated member shorter than said first elongated member, first attachment means for attaching said first end of said first elongated member and said first end of said second elongated member, second attachment means for attaching said second end of said first elongated member to said second end of said second elongated member, a first stop member, first stop member attachment means for attaching said first stop member and said first elongated member, a second stop member, and second stop member attachment means for attaching said second stop member and said second elongated member, with said first and second elongated members forming a frame.

2. A round top window frame according to claim 1, in which said curvature of said first elongated member forms a segment of a circle.

3. A round top window frame according to claim 1, in which said curvature of said first elongated member forms a non-circular curve.

4. A round top window frame according to claim 1, further comprising window glazing means proportioned to fit within said frame defined by said first and second elongated members and disposed resting against said first and said second stop members.

5. A round top window frame according to claim 4, further comprising glazing bead means and mounting means for mounting said glazing bead means on said first and second elongated member means and disposed bearing against said window glazing means.

6. A round top window frame according to claim 5, in which said glazing bead means comprises an elongated elastomeric member.

7. A found top window frame according to claim 1, further comprising first nail fin member means and a second nail fin member means and attachment means for attaching said first nail fin member means to said first elongated member and said second nail fin member means to said second elongated member.

8. A round top window frame according to claim 7, in which said attachment means for attaching said first nail fin member means to said first elongated member and said second nail fin member means to said second elongated member means comprises a slot portion formed in said first and said second elongated member means and a projecting portion formed on each of said nail fin member means with said projecting means of said first and said second nail fin member means engaging said slot portions of said first and said second elongated member means respectively.

9. A round top window according to claim 7, in which said first nail fin member means comprises a slotted member.

10. A round, top window according to claim 1, in which said first and said second attachment means comprises a pair of screw bosses formed on at least said second elongated member and a first and second pair of screws disposed passing through said first and said second ends of said first elongated members and engaging said screw bosses.

11. A round top window frame according to claim 1 in which said first and said second elongated members and said first and said second stop means are each made of plastic.

12. A round top window frame according to claim 1 in which said first and said second elongated members and said first and said second stop means are each made of polyvinylchloride.

13. A round top window frame according to claim 1, in which said first elongated member and said first stop member are each relatively flexible.

14. A round top window frame comprising a first elongated member having a first end and a second end, with said first elongated member having a curved configuration, a second elongated member having a first end and a second end, with said second elongated member shorter than said first elongated member, first attachment means for attaching said first end of said first elongated member and said first end of said second elongated member, second attachment means for attaching said second end of said first elongated member to said second end of said second elongated member, a first stop member, first stop member attachment means for attaching said first stop member and said first elongated member, a second stop member, and second stop member attachment means for attaching said second stop member and said second elongated member, with said first and second elongated members forming a frame, window glazing bead means, window glazing bead means proportioned to fit within said frame defined by said first and second elongated members and disposed resting against said first and said second stop members, and mounting means for mounting said glazing bead means on said first and second elongated member means and disposed bearing against said window glazing means, with said mounting means comprising elongated cavity portions formed in said first and said second elongated member means and a projecting portion formed on said glazing bead means, with said projecting portion disposed projecting into said cavity portion.

15. A round top window frame comprising a first elongated member having a first end and a second end, with said first elongated member having a curved configuration, a second elongated member having a first end and a second end, with said second elongated member shorter than said first elongated member, first attachment means for attaching said first end of said first elongated member and said first end of said second elongated member, second attachment means for attaching said second end of said first elongated member to said second end of said second elongated member, a first stop member, first stop member attachment means for attaching said first stop member and said first elongated member, a second stop member, and second stop member attachment means for attaching said second stop member and said second elongated member, with said first and second elongated members forming a frame, window glazing means proportioned to fit within said frame defined by said first and second elongated members and disposed resting against said first and said second stop member, and window glazing beam means, mounting means for mounting said glazing bead means on said first and second elongated member means and disposed bearing against said window glazing means, with said mounting means comprising elongated cavity portions formed in said first and said second elongated member means and a projecting portion formed on said glazing bead means, with said projecting portion disposed projecting into said cavity portion and with said cavity portion having a convoluted cross-section.

16. A round top window frame comprising a first elongated member having a first end and a second end, with said first elongated member having a curved configuration, a second elongated member having a first end and a second end, with said second elongated member shorter than said first elongated member, first attachment means for attaching said first end of said first elongated member and said first end of said second elongated member, second attachment means for attaching said second end of said first elongated member to said second end of said second elongated member, a first stop member, first stop member attachment means for attaching said first stop member and said first elongated member, a second stop member, and second stop member attachment means for attaching said second stop member and said second elongated member, with said first and second elongated members forming a frame, with said first and said second elongated members each comprising integrally formed hollow members.

17. A round top window frame comprising a first elongated member having a first end and a second end, with said first elongated member having a curved configuration, a second elongated member having a first end and a second end, with said second elongated member shorter than said first elongated member, with said first and said second elongated members being rectangular in cross section, first attachment means for attaching said first end of said first elongated member and said first end of said second elongated member, second attachment means for attaching said second end of said first elongated member to said second end of said second elongated member, a first stop member, first stop member attachment means for attaching said first stop member and said first elongated member, a second stop member, and second stop member attachment means for attaching said second stop member and said second elongated member, with said first and second elongated members forming a frame, with said cavity portion having a convoluted cross-section and with said first and said second elongated members each comprising integrally formed hollow members.

18. A round top window frame comprising a first elongated member having a first end and a second end, with said first elongated member having a curved configuration, a second elongated member having a first end and a second end, with said second elongated member shorter than said first elongated member, first attachment means for attaching said first end of said first elongated member and said first end of said second elongated member, second attachment means for attaching said second end of said first elongated member to said second end of said second elongated member, a first stop member, first stop member attachment means for attaching said first stop member and said first elongated member, a second stop member, and second stop member attachment means for attaching said second stop member and said second elongated member, with said first and said second stop member attachment means each comprising at least one pair of screws.

* * * * *